US009914147B2

(12) United States Patent
Harris et al.

(10) Patent No.: US 9,914,147 B2
(45) Date of Patent: Mar. 13, 2018

(54) LIQUID DISPENSER HAVING INDIVIDUALIZED PROCESS AIR CONTROL

(75) Inventors: Michael Harris, Cumming, GA (US); David Carson King, Jr., Duluth, GA (US); Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 1413 days.

(21) Appl. No.: 12/159,008

(22) PCT Filed: Dec. 28, 2006

(86) PCT No.: PCT/US2006/049418

§ 371 (c)(1),
(2), (4) Date: Sep. 16, 2008

(87) PCT Pub. No.: WO2007/081562

PCT Pub. Date: Jul. 19, 2007

(65) Prior Publication Data

US 2009/0065611 A1 Mar. 12, 2009

Related U.S. Application Data

(60) Provisional application No. 60/757,045, filed on Jan. 6, 2006.

(51) Int. Cl.
*B05C 5/02* (2006.01)
*B05B 7/08* (2006.01)

(52) U.S. Cl.
CPC ..... *B05C 5/0279* (2013.01); *B05B 7/08* (2013.01)

(58) Field of Classification Search
CPC ..... B05C 5/0279; B05B 7/08; B05B 1/24; B05B 1/3405; B05B 7/066; B05B 7/0815; B05B 7/10; B05B 7/16; B05B 7/22
(Continued)

(56) References Cited

U.S. PATENT DOCUMENTS 3,006,559 A * 10/1961 Schmidt ..... 239/414
3,840,158 A 10/1974 Baker et al.
(Continued)

FOREIGN PATENT DOCUMENTS

DE 8534594.6 U1 3/1986
EP 0282748 A1 9/1988
(Continued)

OTHER PUBLICATIONS

U.S. Patent and Trademark Office, Final Office Action in U.S. Appl. No. 11/748,765, dated Jan. 15, 2009.
(Continued)

*Primary Examiner* — Christopher Kim
(74) *Attorney, Agent, or Firm* — Baker & Hostetler LLP

(57) ABSTRACT

A dispenser for dispensing liquid material while attenuating the liquid material or controlling the pattern of the liquid material with process air has a plurality of process air passages for providing process air to one or more liquid dispensing modules or nozzles. The flow rate of process air provided to one or more of the modules or nozzles may be separately controlled to be different from the flow rate provided to other modules or nozzles on the dispenser. Accordingly, the flow rate provided to each module or nozzle can be optimized to accommodate a particular dispensing nozzle or die.

11 Claims, 11 Drawing Sheets

(58) Field of Classification Search
USPC ..... 239/413, 416.4, 417.5, 423–424.5
See application file for complete search history.

(56) References Cited

U.S. PATENT DOCUMENTS

| | | | | |
|---|---|---|---|---|
| 3,849,241 | A | | 11/1974 | Butin et al. |
| 4,073,850 | A | | 2/1978 | Brackmann et al. |
| 4,079,864 | A | | 3/1978 | Cox |
| 4,478,624 | A | | 10/1984 | Battigelli et al. |
| 4,488,665 | A | | 12/1984 | Cocks et al. |
| 4,526,733 | A | | 7/1985 | Lau |
| 4,669,661 | A | * | 6/1987 | Otto ..... 239/132.1 |
| 4,687,137 | A | | 8/1987 | Boger et al. |
| 4,708,619 | A | | 11/1987 | Balk |
| 4,785,996 | A | | 11/1988 | Ziecker et al. |
| 4,815,660 | A | | 3/1989 | Boger |
| 4,891,249 | A | | 1/1990 | McIntyre |
| 4,911,956 | A | | 3/1990 | Gabryszewski et al. |
| 4,949,668 | A | | 8/1990 | Heindel et al. |
| 4,983,109 | A | | 1/1991 | Miller et al. |
| 5,000,112 | A | | 3/1991 | Rothen et al. |
| 5,005,640 | A | | 4/1991 | Lapinski et al. |
| 5,020,723 | A | * | 6/1991 | Crist ..... 239/11 |
| 5,102,484 | A | | 4/1992 | Allen et al. |
| 5,145,689 | A | | 9/1992 | Allen et al. |
| 5,172,833 | A | | 12/1992 | Faulkner, III |
| 5,194,115 | A | | 3/1993 | Ramspeck et al. |
| 5,236,641 | A | | 8/1993 | Allen et al. |
| 5,238,190 | A | | 8/1993 | Herke |
| 5,265,800 | A | | 11/1993 | Ziecker et al. |
| 5,269,670 | A | * | 12/1993 | Allen et al. ..... 425/72.2 |
| 5,368,233 | A | | 11/1994 | Brusko |
| 5,382,312 | A | | 1/1995 | Raterman |
| 5,407,101 | A | | 4/1995 | Hubbard |
| 5,418,009 | A | | 5/1995 | Raterman et al. |
| 5,421,941 | A | | 6/1995 | Allen et al. |
| 5,422,428 | A | | 6/1995 | McGuire et al. |
| 5,429,840 | A | | 7/1995 | Raterman et al. |
| 5,445,509 | A | | 8/1995 | Allen et al. |
| 5,445,674 | A | | 8/1995 | DeMars |
| 5,458,291 | A | * | 10/1995 | Brusko et al. ..... 239/423 |
| 5,533,675 | A | | 7/1996 | Benecke et al. |
| 5,540,804 | A | | 7/1996 | Raterman |
| 5,556,471 | A | | 9/1996 | Boccagno et al. |
| 5,605,720 | A | | 2/1997 | Allen et al. |
| 5,618,566 | A | | 4/1997 | Allen et al. |
| 5,620,139 | A | | 4/1997 | Ziecker |
| 5,636,790 | A | | 6/1997 | Brusko et al. |
| 5,679,379 | A | | 10/1997 | Fabbricante et al. |
| 5,683,752 | A | | 11/1997 | Popp et al. |
| 5,685,911 | A | | 11/1997 | Raterman et al. |
| 5,700,322 | A | | 12/1997 | Fort |
| 5,728,219 | A | | 3/1998 | Allen et al. |
| 5,740,963 | A | | 4/1998 | Riney et al. |
| 5,747,102 | A | | 5/1998 | Smith et al. |
| 5,823,437 | A | | 10/1998 | Bolyard, Jr. |
| 5,862,986 | A | | 1/1999 | Bolyard, Jr. et al. |
| 5,875,922 | A | | 3/1999 | Chastine et al. |
| 5,950,875 | A | | 9/1999 | Lee et al. |
| 6,089,413 | A | | 7/2000 | Riney et al. |
| 6,210,141 | B1 | | 4/2001 | Allen |
| 6,220,843 | B1 | | 4/2001 | Allen |
| 6,222,166 | B1 | | 4/2001 | Lin et al. |
| 6,286,551 | B1 | | 9/2001 | Flatt et al. |
| 6,296,463 | B1 | | 10/2001 | Allen |
| 6,342,264 | B1 | | 1/2002 | Raterman et al. |
| 6,422,428 | B1 | | 7/2002 | Allen et al. |
| 6,457,608 | B1 | | 10/2002 | Riney |
| 6,499,629 | B1 | | 12/2002 | Colangelo et al. |
| 6,499,631 | B2 | | 12/2002 | Zook |
| 6,688,498 | B1 | | 2/2004 | McGuffey |
| 6,874,708 | B2 | | 4/2005 | Reetz, III |
| 7,059,545 | B2 | | 6/2006 | Reetz, III |
| RE39,399 | E | | 11/2006 | Allen |
| 7,322,188 | B2 | * | 1/2008 | Cline et al. ..... 60/407 |
| 7,614,525 | B2 | | 11/2009 | Saidman |
| 7,617,951 | B2 | | 11/2009 | Saidman et al. |
| 2002/0092865 | A1 | | 7/2002 | Takagi et al. |
| 2002/0139818 | A1 | | 10/2002 | McGuffey |
| 2003/0062384 | A1 | | 4/2003 | McGuffey |
| 2003/0168180 | A1 | | 9/2003 | Saidman et al. |
| 2004/0159672 | A1 | | 8/2004 | Auber et al. |
| 2004/0195378 | A1 | | 10/2004 | Reetz |
| 2005/0092775 | A1 | | 5/2005 | Saidman et al. |
| 2005/0098654 | A1 | | 5/2005 | Reetz |
| 2005/0098655 | A1 | | 5/2005 | Reetz |
| 2005/0242108 | A1 | | 11/2005 | Harris et al. |
| 2006/0225413 | A1 | * | 10/2006 | Cline et al. ..... 60/407 |
| 2007/0215718 | A1 | | 9/2007 | Saidman |
| 2010/0018996 | A1 | | 1/2010 | Saidman |
| 2011/0006082 | A1 | | 1/2011 | Saidman et al. |

FOREIGN PATENT DOCUMENTS

| | | | |
|---|---|---|---|
| EP | 0819477 | A2 | 1/1998 |
| EP | 0820817 | A2 | 1/1998 |
| EP | 0936000 | A2 | 8/1999 |
| EP | 0997200 | A1 | 5/2000 |
| EP | 1591167 | A1 | 11/2005 |
| JP | 06170308 | A | 6/1994 |
| JP | 07171465 | A | 7/1995 |
| JP | 08052388 | A | 2/1996 |
| JP | 08168703 | A | 7/1996 |
| JP | 10066922 | A | 3/1998 |
| JP | 2000070818 | A | 3/2000 |
| JP | 2001170540 | A | 6/2001 |
| JP | 2001293399 | A | 10/2001 |
| JP | 2002505951 | A | 2/2002 |
| JP | 2002512121 | A | 4/2002 |
| JP | 2003164786 | A | 6/2003 |
| JP | 2004243318 | A | 9/2004 |
| JP | 2004255374 | A | 9/2004 |
| JP | 2004344855 | A | 12/2004 |
| WO | 94/01221 | A1 | 1/1994 |
| WO | 9718054 | A1 | 5/1997 |
| WO | 99/46057 | A1 | 9/1999 |

OTHER PUBLICATIONS

U.S. Patent and Trademark Office, Office Action in U.S. Appl. No. 11/836,765, dated Jul. 27, 2009.

U.S. Patent and Trademark Office, Final Office Action in U.S. Appl. No. 11/836,765, dated Sep. 11, 2008.

European Patent Office, International Preliminary Report on Patentability in PCT Serial No. PCT/US2006/049418, dated Jul. 21, 2008.

ITW Dynatec, The Dynatec Advantage, Patented Vector Metering Applicator, Product Description, 2 pgs.

European Patent Office, International Search Report and Written Opinion in PCT Application Serial No. PCT/US2006/049418, dated May 14, 2007.

European Patent Office, European Search Report in EP Application Serial No. 03000838, dated Apr. 27, 2007.

European Patent Office, European Search Report in EP Application Serial No. 05007249, dated Jun. 13, 2005.

U.S. Patent and Trademark Office, Office Action in U.S. Appl. No. 11/748,765, dated Jun. 27, 2008.

U.S. Patent and Trademark Office, Office Action in U.S. Appl. No. 10/836,765, dated Apr. 9, 2008.

U.S. Patent and Trademark Office, Final Office Action in U.S. Appl. No. 10/282,573, dated Apr. 16, 2008.

U.S. Patent and Trademark Office, Office Action in U.S. Appl. No. 10/282,573, dated Oct. 9, 2007.

U.S. Patent and Trademark Office, Final Office Action in U.S. Appl. No. 10/282,573, dated Jan. 29, 2007.

U.S. Patent and Trademark Office, Office Action in U.S. Appl. No. 10/282,573, dated May 20, 2005.

U.S. Patent and Trademark Office, Office Action in U.S. Appl. No. 10/282,573, dated Mar. 22, 2005.

(56) References Cited

OTHER PUBLICATIONS

Nordson Corporaton, Precision with Flexibility, The CF800M Metered Head, Trends, 1993.
U.S. Patent and Trademark Office, Final Office Action in U.S. Appl. No. 10/836,765, dated Sep. 11, 2008.
European Patent Office, Extended Search Report in European Application No. 09164785.9, dated Dec. 2, 2009.
U.S. Patent and Trademark Office, Office Action in U.S. Appl. No. 10/282,573, dated Dec. 11, 2008.
U.S. Patent and Trademark Office, Office Action in U.S. Appl. No. 12/569,240, dated Dec. 28, 2009.
U.S. Patent and Trademark Office, Office Action in U.S. Appl. No. 12/569,240, dated Aug. 6, 2010.
U.S. Patent and Trademark Office, Final Office Action in U.S. Appl. No. 10/836,765, dated Jun. 29, 2010.
European Patent Office, European Search Report in European Application No. 10191176, dated Mar. 10, 2011.
European Patent Office, European Search Report in European Application No. 10191188, dated Mar. 10, 2011.
European Patent Office, European Search Report in European Application No. 10191181, dated Mar. 10, 2011.
European Patent Office, European Search Report in European Application No. 10177926, dated Nov. 16, 2010.
U.S. Patent and Trademark Office, Office Action in U.S. Appl. No. 12/569,240, dated Mar. 10, 2011.
U.S. Patent and Trademark Office, Office Action in U.S. Appl. No. 12/884,538, dated Oct. 19, 2011.
U.S. Patent and Trademark Office, Notice of Allowance issued in U.S. Appl. No. 11/748,765, dated Jun. 29, 2009.
European Patent Office, European Search Report issued in European Application No. 10191510.6 dated Feb. 4, 2011.
U.S. Patent and Trademark Office, Notice of Allowance issued in U.S. Appl. No. 12/569,240 dated Nov. 7, 2011
U.S. Patent and Trademark Office, Office Action issued in U.S. Appl. No. 10/836,765 dated Jan. 19, 2012.
Japanese Patent Office, Office Action in Japanese Patent Application No. 2005-130653 dated Jun. 29, 2011 including translation.
U.S. Patent and Trademark Office, Notice of Allowance issued in U.S. Appl. No. 12/569,240, dated Feb. 28, 2012.

* cited by examiner

LIQUID DISPENSER HAVING INDIVIDUALIZED PROCESS AIR CONTROL

FIELD OF THE INVENTION

The present invention relates generally to continuous and intermittent liquid material dispensing systems using process air and having plural nozzles or modules for dispensing the liquid onto a substrate and, in particular, to such systems in which the process air to individual nozzles or modules is separately controlled.

BACKGROUND OF THE INVENTION

Thermoplastic materials, such as hot melt adhesives, are used in a variety of applications including the manufacture of diapers, sanitary napkins, surgical drapes and various other products. The technology has evolved from the application of linear beads or fibers of material and other spray patterns, to air-assisted applications, such as spiral and melt-blown depositions of fibrous material.

One type of known intermittently operable liquid dispensing system includes one or more dispensing modules for applying liquid material in an intended deposition pattern from respectively associated modules. These modules include valve components that permit the individual modules to operate in an on/off fashion. One example of this type of dispensing module is disclosed in U.S. Pat. No. 6,089,413, assigned to the assignee of the present invention. The module includes valve structure that changes the module between on and off conditions. In the off condition, the module enters a recirculating mode. Three-way versions of these modules have a recirculating mode that redirects the pressurized material from the liquid material inlet of the module to a recirculation outlet which, for example, leads back into a supply manifold and prevents the material from stagnating. Other two-way modules, without recirculation, have also been used to provide selective metering and/or on/off control of material deposition. Another type of liquid dispensing system, referred to as a continuous applicator, includes a plurality of liquid dispensing nozzles or dies for dispensing liquid material to a substrate, wherein all the nozzles are simultaneously controlled such that all the nozzles are either on or off.

Various liquid dispensing systems have been developed that can accommodate varying numbers of modules. Different types of dispensing modules, or similar modules having different dies or nozzles, may be used with these systems so that a variety of deposition patterns across the applicator may be applied to a substrate. The most common types of air-assisted dies or nozzles include melt-blowing nozzles and dies and spiral nozzles. Pressurized air is used to either draw down or attenuate the fiber diameter in a melt-blowing application, or to produce a particular deposition pattern in other applications, such as when using spiral nozzles. When using hot melt adhesives or other heated thermoplastic materials, the process or "pattern" air may be heated so that it does not substantially cool the thermoplastic material prior to deposition on the substrate.

An exemplary applicator that allows users to tailor the applicator to specific needs is shown and described in U.S. Pat. No. 6,422,428, commonly assigned to the assignee of the present invention and hereby incorporated by reference herein in its entirety. This applicator comprises multiple manifold segments and associated liquid dispensing modules secured to the manifolds segments. Manifold segments may be selectively added or removed from the applicator to optimize the spray performance of liquid material dispensed from the respective liquid dispensing modules.

When different types of liquid dispensing modules are used on a single dispenser, or when different types of nozzles or dies are used with the modules on a multi-module dispenser, it may be desirable to control the process air provided to individual modules or nozzles so that the performance of each module or module/nozzle combination is optimized. Pending U.S. patent application Ser. No. 10/282,573 and pending U.S. patent application Ser. No. 10/836,765, each of which is assigned to the assignee of the present invention, disclose various embodiments of liquid dispensing systems having a plurality of liquid dispensing modules for dispensing liquid material. These systems include controls between an air supply and the liquid dispensing systems to control the flow rate and/or flow rate of process air provided to individual modules. In some applications, it may be desirable to control process air at points in the system that are closer to locations where process air exits the individual nozzles or dies. This application discloses various embodiments of liquid dispensing systems wherein process air provided to one or more modules or nozzles is independently regulated by controls provided at locations other than between an air supply and the liquid dispensing system.

SUMMARY OF THE INVENTION

The present invention provides a liquid material dispenser that utilizes pressurized process or pattern air to attenuate the liquid material dispensed therefrom or to manipulate the pattern of liquid material dispensed therefrom. The liquid material dispenser comprises a first manifold adapted to receive pressurized air and a second manifold adapted to receive liquid material. The first manifold has a first air passage for supplying a first air stream and a second air passage for supplying a second air stream. The second manifold has a first liquid material passage for supplying a first liquid material stream and a second liquid material passage for supplying a second liquid material stream. A first nozzle is coupled with the first air passage and the first liquid material passage. A second nozzle is coupled with the second air passage and the second liquid material passage. A first control communicates with the first air passage in the first manifold and a second control communicating with the second air passage in the first manifold. The first control is operative to adjust a first flow rate in the first air passage independent of a second flow rate in the second air passage.

In another embodiment of the present invention, a liquid material dispenser comprises a first manifold adapted to receive pressurized air and a second manifold adapted to receive liquid material. The first manifold has a first air passage for supplying a first air stream and a second air passage for supplying a second air stream. The second manifold has a first liquid material passage for supplying a first liquid material stream and a second liquid material passage for supplying a second liquid material stream. A first dispensing device is coupled with the first liquid material passage and a second dispensing device is coupled with the second liquid material passage. The first dispensing device has a first air passageway coupled with the first air passage and a first control communicating with the first air passageway. The second dispensing device has a second air passageway coupled with the second air passage and a second control communicating with the second air passageway. The first control is operative to adjust a first flow rate in the first air passageway. The second control is operative to adjust a second flow rate in the second air passageway independent of the first flow rate in the first air passageway.

In another embodiment of the present invention, a liquid material dispenser comprises a manifold adapted to receive liquid material, a first air line adapted to supply a first air stream from a pressurized air source, and a second air line adapted to supply a second air stream from the pressurized air source. The liquid manifold has a first liquid material passage for supplying a first liquid material stream and a second liquid material passage for supplying a second liquid material stream. A first dispensing device is coupled with the first liquid material passage and a second dispensing device coupled with the second liquid material passage. The first dispensing device has a first air passageway coupled with the first air line and a first control communicating with the first air passageway. The second dispensing device has a second air passageway coupled with the second air line and a second control communicating with the second air passageway. The first control is operative to adjust a first flow rate in the first air passageway. The second control is operative to adjust a second flow rate in the second air passageway independent of the first flow rate in the first air passageway.

In another embodiment of the present invention, a liquid material dispenser comprises a manifold adapted to receive liquid material. The liquid manifold has a first liquid material passage for supplying a first liquid material stream and a second liquid material passage for supplying a second liquid material stream. A first dispensing device is coupled with the first liquid material passage and a second dispensing device is coupled with the second liquid material passage. The first dispensing device has a first air passageway and the second dispensing device has a second air passageway. A first air line is adapted to supply a first air stream from a pressurized air source to the first air passageway of the first dispensing device. A second air line is adapted to supply a second air stream from the pressurized air source to the second air passageway of the second dispensing device. A first control is operative to adjust a first flow rate in the first air line. A second control is operative to adjust a second flow rate in the second air line independent of the first flow rate in the first air line.

In another embodiment of the present invention, a liquid material dispenser comprises a manifold adapted to receive pressurized air and liquid material. The manifold has a first liquid material passage for supplying a first liquid material stream, a second liquid material passage for supplying a second liquid material stream, a first air passage for supplying a first air stream, and a second air passage for supplying a second air stream. A first nozzle is coupled with the first air passage for receiving the first air stream and the first liquid material passage for receiving the first liquid material stream. A second nozzle is coupled with the second air passage for receiving the second air stream and the second liquid material passage for receiving the second liquid material stream. A first control communicates with the first air passage in the manifold and a second control communicates with the second air passage in the manifold. The first control is operative to adjust a first flow rate in the first air passage independent of a second flow rate in the second air passage.

In another embodiment of the present invention, a liquid material dispenser comprises a manifold adapted to receive pressurized air and liquid material. The manifold has a first liquid material passage for supplying a first liquid material stream, a second liquid material passage for supplying a second liquid material stream, a first air passage for supplying a first air stream, and a second air passage for supplying a second air stream. A first dispensing device is coupled with the first liquid material passage and a second dispensing device is coupled with the second liquid material passage. The first dispensing device has a first air passageway coupled with the first air passage and a first control communicating with the first air passageway. The second dispensing device has a second air passageway coupled with the second air passage and a second control communicating with the second air passageway. The first control is operative to adjust a first flow rate in the first air passageway. The second control is operative to adjust a second flow rate in the second air passageway independent of the first flow rate in the first air passageway.

In another embodiment of the present invention, a liquid material dispenser comprises a first manifold adapted to receive liquid material, a second manifold adapted to receive liquid material, a first air line adapted to supply a first air stream from a pressurized air source, and a second air line adapted to supply a second air stream from the pressurized air source. The first manifold has a first liquid material passage for supplying a first liquid material stream and the second manifold has a second liquid material passage for supplying a second liquid material stream. A first dispensing device is coupled with the first liquid material passage and a second dispensing device is coupled with the second liquid material passage. The first dispensing device has a first air passageway coupled by the first air line with the pressurized air source and a first control communicating with the first air passageway. The second dispensing device has a second air passageway coupled by the second air line with the pressurized air source and a second control communicating with the second air passageway. The first control is operative to adjust a first flow rate in the first air passageway. The second control is operative to adjust a second flow rate in the second air passageway independent of the first flow rate in the first air passageway.

In another embodiment of the present invention, a liquid material dispenser comprises a first manifold adapted to receive liquid material and a second manifold having a second liquid material passage adapted to receive liquid material. The first manifold has a first liquid material passage for supplying a first liquid material stream and the second manifold has a second liquid material passage for supplying a second liquid material stream. A first air line is adapted to supply a first air stream from a pressurized air source and a second air line adapted to supply a second air stream from the pressurized air source. A first dispensing device is coupled with the first liquid material passage and a second dispensing device is coupled with the second liquid material passage. The first dispensing device has a first air passageway coupled with the first air line and the second dispensing device has a second air passageway coupled with the second air line. A first control is operative to adjust a first flow rate in the first air line. A second control is operative to adjust a second flow rate in the second air line independent of the first flow rate in the first air line.

In another embodiment of the present invention, a liquid material dispenser comprises a first manifold adapted to receive pressurized air and liquid material and a second manifold adapted to receive pressurized air and liquid material. The first manifold has a first air passage for supplying a first air stream and a first liquid material passage for supplying a first liquid material stream. The second manifold has a second air passage for supplying a second air stream and a second liquid material passage for supplying a second liquid material stream. A first nozzle is coupled with the first air passage and the first liquid material passage. The first nozzle receives the first air stream and the first liquid material stream. A second nozzle is coupled with the second air passage and the second liquid material passage. The second nozzle receiving the second air stream and the second liquid material stream. A first control communicates with the first air passage in the first manifold and a second control communicates with the second air passage in the second manifold. The first control is operative to adjust a first flow rate in the first air passage independent of a second flow rate in the second air passage.

In another embodiment of the present invention, a liquid material dispenser comprises a first manifold adapted to receive pressurized air and liquid material and a second manifold adapted to receive pressurized air and liquid material. The first manifold has a first air passage for supplying a first air stream and a first liquid material passage for supplying a first liquid material stream. The second manifold has a second air passage for supplying a second air stream and a second liquid material passage for supplying a second liquid material stream. A first dispensing device is coupled with the first liquid material passage and a second dispensing device coupled with the second liquid material passage. The first dispensing device has a first air passageway coupled with the first air passage and a first control communicating with the first air passageway. The second dispensing device has a second air passageway coupled with the second air passage and a second control communicating with the second air passageway. The first control is operative to adjust a first flow rate in the first air passageway. The second control is operative to adjust a second flow rate in the second air passageway independent of the first flow rate in the first air passageway.

In another embodiment of the present invention, a liquid material dispenser comprises a first liquid manifold adapted to receive liquid material and a second liquid manifold adapted to receive liquid material. The first liquid manifold has a first liquid material passage for supplying a first stream of liquid material and the second liquid manifold has a second liquid material passage for supplying a second stream of liquid material. A first air manifold is adapted to receive pressurized air and has a first air passage for supplying a first air stream. A second air manifold is adapted to receive pressurized air and has a second air passage for supplying a second air stream. A first nozzle is coupled with the first air passage and the first liquid material passage. A second nozzle is coupled with the second air passage and the second liquid material passage. A first control communicates with the first air passage in the first manifold. A second control communicates with the second air passage in the first manifold. The first control is operative to adjust a first flow rate in the first air passage independent of a second flow rate in the second air passage.

In another embodiment of the present invention, a liquid material dispenser comprises a first liquid manifold adapted to receive liquid material and a second liquid manifold adapted to receive liquid material. The first liquid manifold has a first liquid material passage for supplying a first stream of liquid material. The second liquid manifold has a second liquid material passage for supplying a second stream of liquid material. A first air manifold is adapted to receive pressurized air and has a first air passage for supplying a first air stream. A second air manifold is adapted to receive pressurized air and has a second air passage for supplying a second air stream. A first dispensing device is coupled with the first liquid material passage and a second dispensing device is coupled with the second liquid material passage. The first dispensing device has a first air passageway coupled with the first air passage and a first control communicating with the first air passageway. The second dispensing device has a second air passageway coupled with the second air passage and a second control communicating with the second air passageway. The first control is operative to adjust a first flow rate in the first air passageway. The second control is operative to adjust a second flow rate in the second air passageway independent of the first flow rate in the first air passageway.

In another embodiment of the present invention, a liquid material dispenser comprises a first liquid manifold adapted to receive liquid material, a first air manifold adapted to receive pressurized air, and a second air manifold adapted to receive pressurized air. The first liquid manifold has a first liquid material passage for supplying a first stream of liquid material and a second liquid material passage for supplying a third stream of liquid material. The first air manifold has a first air passage for supplying a first air stream and the second air manifold has a second air passage for supplying a second air stream. A first nozzle is coupled with the first air passage and the first liquid material passage. A second nozzle is coupled with the second air passage and the second liquid material passage. A first control communicates with the first air passage in the first air manifold. A second control communicates with the second air passage in the second air manifold. The first control is operative to adjust a first flow rate in the first air passage independent of a second flow rate in the second air passage.

In another embodiment of the present invention, a liquid material dispenser comprises a first liquid manifold adapted to receive liquid material, a first air manifold adapted to receive pressurized air, and a second air manifold adapted to receive pressurized air. The first liquid manifold has a first liquid material passage for supplying a first stream of liquid material and a second liquid material passage for supplying a second stream of liquid material. The first air manifold adapted has a first air passage for supplying a first air stream and the second air manifold has a second air passage for supplying a second air stream. A first dispensing device is coupled with the first liquid material passage. The first dispensing device has a first air passageway coupled with the first air passage and a first control communicating with the first air passageway. A second dispensing device is coupled with the second liquid material passage. The second dispensing device has a second air passageway coupled with the second air passage and a second control communicating with the second air passageway. The first control is operative to adjust a first flow rate in the first air passageway. The second control is operative to adjust a second flow rate in the second air passageway independent of the first flow rate in the first air passageway.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Pending U.S. patent application Ser. No. 10/282,573 and pending U.S. application Ser. No. 10/836,765, assigned to the Assignee of the present invention and hereby incorporated by reference herein in their entirety, disclose various embodiments of liquid dispensing systems having a plurality of liquid dispensing modules for dispensing liquid material. Controls between an air supply and the liquid dispensing systems are operative to control the flow rate and/or flow rate of process air provided to individual modules. This application is directed to various other embodiments of liquid dispensing systems that are capable of controlling process air provided to one or more modules independently of process air provided to one or more other modules. While certain embodiments are described herein with respect to liquid dispensing systems having one or more modules for on\off control of liquid dispensed from individual dies or nozzles, it will be appreciated that individual control of process air is also applicable to continuous-type dispensing systems wherein all modules are simultaneously turned on or off.

Figure 1:
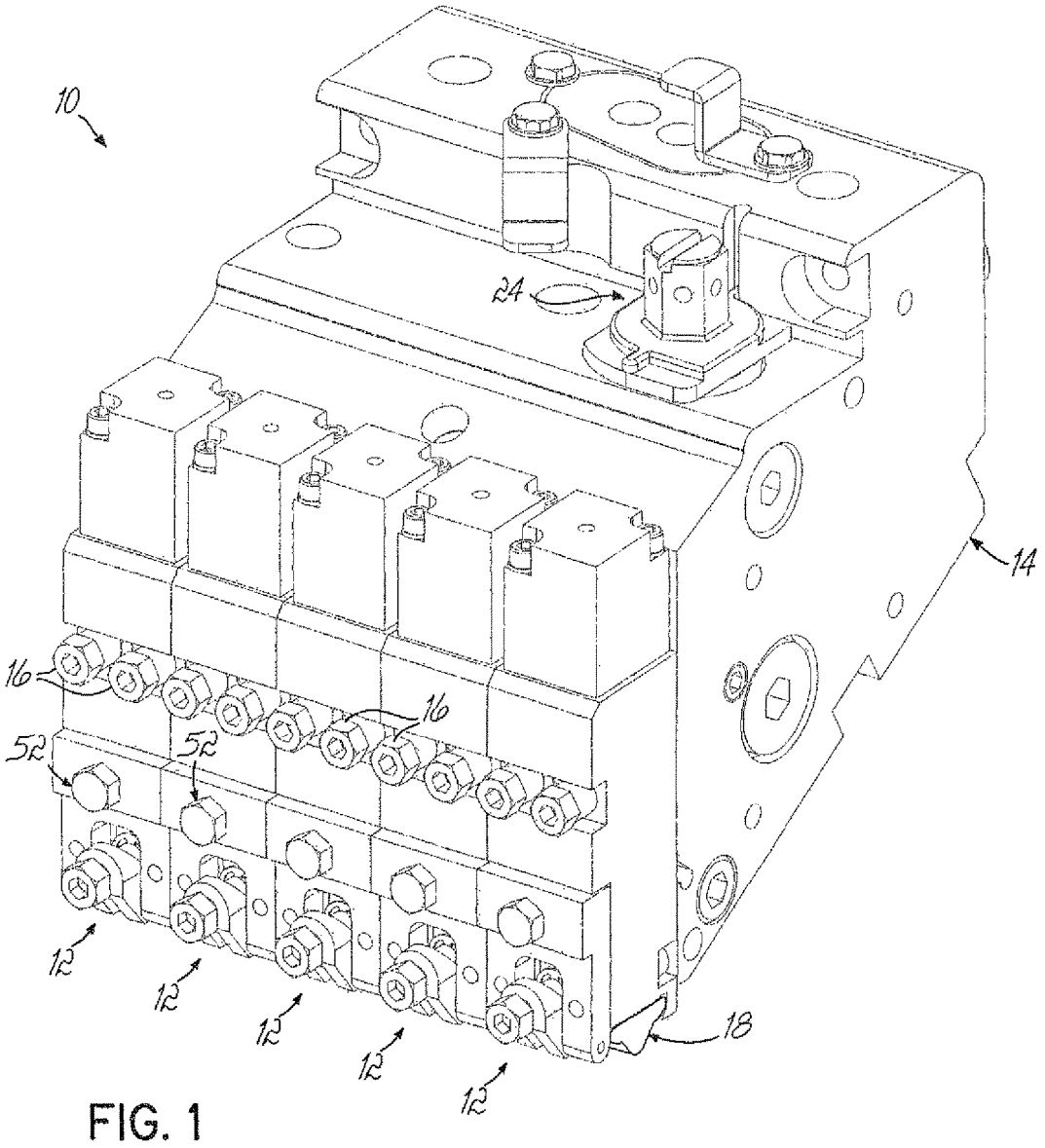
FIG. 1 is a perspective view of an exemplary liquid dispensing system in accordance with the principles of the present invention.
Figure 2:
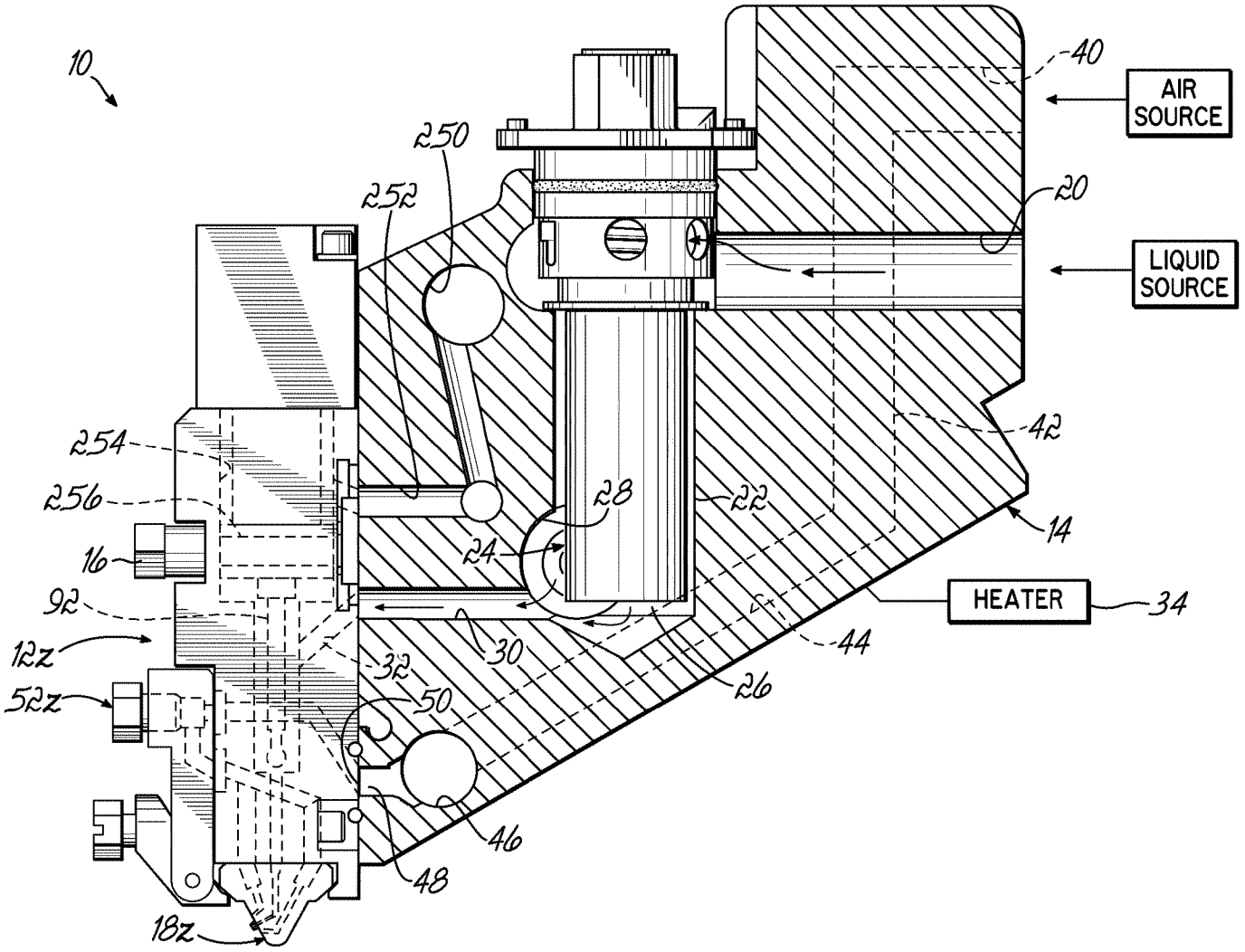
FIG. 2 is a cross-sectional view of the liquid dispensing system of FIG. 1.

FIGS. 1 and 2, depict an exemplary liquid dispensing system 10 in accordance with the principles of the present invention, wherein a plurality of dispensing modules 12 are coupled to a common (un-segmented) manifold body 14 that is adapted to receive the multiple modules 12 and which incorporates liquid manifold functions and air manifold functions into a single, integrated unit, as disclosed in co-pending U.S. patent application Ser. No. 10/830,613, assigned to the Assignee of the present invention and incorporated herein by reference in its entirety. The plurality of liquid dispensing modules 12 are secured to the manifold body 14, for example, by fasteners 16, and are coupled to respective liquid dispensing nozzles or dies 18 as known in the art. As illustrated in FIG. 2, liquid material is supplied from a liquid source to manifold body 14 through a liquid material inlet port 20. The liquid material inlet port 20 leads to a vertically oriented filter cavity 22 formed in the manifold body 14 and sized to receive a filter 24 for removing contaminants from the incoming liquid material. Liquid material exits filter 24 toward the bottom 26 of the filter cavity 22 and enters a liquid distribution passage 28 that extends longitudinally along the manifold body 14. A plurality of liquid outlet passages 30 are formed in the manifold body 14 and intersect the liquid distribution passage 28 whereby liquid material flows from the liquid distribution passage 28 through the liquid outlet passages 30 to corresponding liquid inlet passages 32 provided in each of the modules 12.

Process air from an external source enters the dispenser 10 through an air inlet port 40 formed in the rear surface of the manifold body 14. Process air from the source will generally be provided at an elevated pressure. While this air may be regulated to maintain a desired "pressure," such pressure regulation is not generally intended to adjust the pressure and/or flow rate to the requirements of individual modules or nozzles. Process air travels from the air inlet port 40 through a vertical passage 42 and communicates with an air supply passage 44 that intersects distribution passage 46. Air distribution passage 46 extends longitudinally along the manifold body 14 and communicates with a plurality of air outlet passages 48 to provide process air to corresponding air inlets 50 formed in each of the modules 12.

In the embodiment shown in FIGS. 1 and 2, process air provided to the individual modules 12 is directly controlled at each module 12. Each module 12 includes a control 52, such as a needle valve, to facilitate individual adjustment and control of the pressure and/or flow rate of air provided to module 12 through air inlet passage 50. While control 52 has been shown and described herein as a needle valve, it will be recognized that the control may alternatively be various other devices suitable for controlling the pressure and/or flow rate of the process air. Moreover, while control 52 is depicted as a part of each module 12, it will be appreciated that control 52 may alternatively be located in the flow path between module 12 and its respectively associated nozzle or die 18.

Figure 2A:
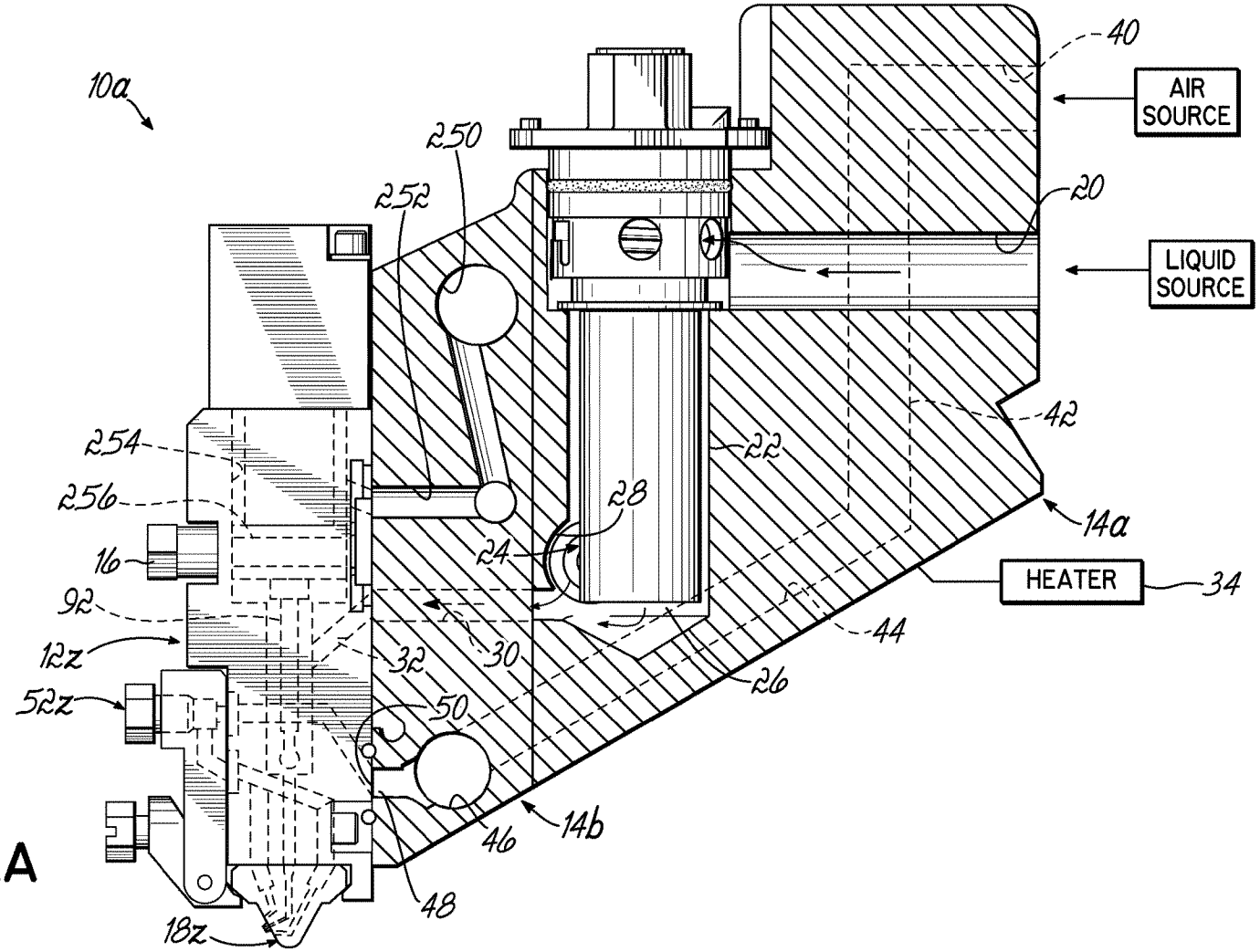
FIG. 2A is a cross-sectional view, similar to FIG. 2, depicting an alternative embodiment of the liquid dispensing system of FIG. 1.

While manifold body 14 has been shown and described in FIG. 2 as having liquid and air manifold functions integrally combined into a single, unitary manifold body, it will be appreciated that the manifold body may alternatively comprise separate liquid manifold portions 14*a* and air manifold portions 14*b* joined together to form dispenser 10*a*, as depicted in FIG. 2A. While the manifold of FIG. 2A is formed from two separate portions 14*a*, 14*b*, operation of the liquid dispensing system 10*a* is otherwise similar to that described above with respect to liquid dispensing system 10 of FIGS. 1 and 2.

Figure 2B:
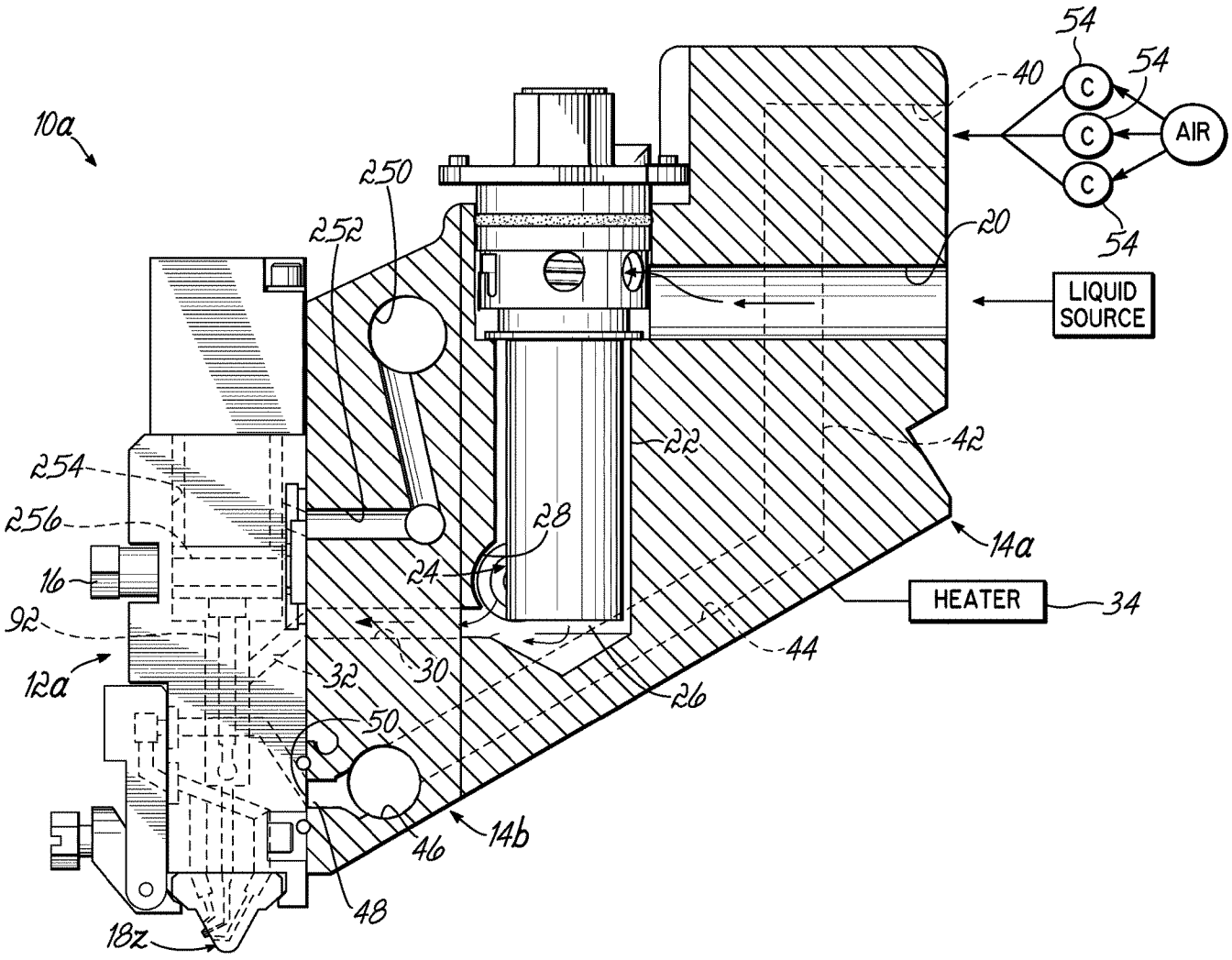
FIG. 2B is a cross-sectional view similar to FIG. 2A, depicting a second exemplary liquid dispensing system in accordance with the principles of the present invention.

FIG. 2B depicts another exemplary liquid dispensing system 10*b*, similar to liquid dispensing system 10*a* of FIG. 2A, wherein the manifold body comprises separate liquid and air manifold portions 14*a*, 14*b*. In this embodiment, however, the pressure and/or flow rate of process air provided to each module 12*a* is regulated by controls 54 disposed between the liquid dispensing system 10*b* and an air source, in a manner similar to that described in pending U.S. patent application Ser. No. 10/282,573.

While the liquid dispensing systems 10, 10*a*, 10*b* shown and described with respect to FIGS. 1, 2, 2A and 2B depict unitary, non-segmented manifold bodies 14, 14*a*, 14*b*, it will be appreciated that a manifold body for a dispensing system in accordance with the principles of the present invention may alternatively be segmented. These segmented manifolds may comprise separate liquid and air manifold portions, as shown and described in pending U.S. patent application Ser. No. 10/282,573, or they may comprise manifolds that are integrated to perform liquid and air manifold functions, as shown and described in pending U.S. patent application Ser. No. 10/836,765.

Figure 3:
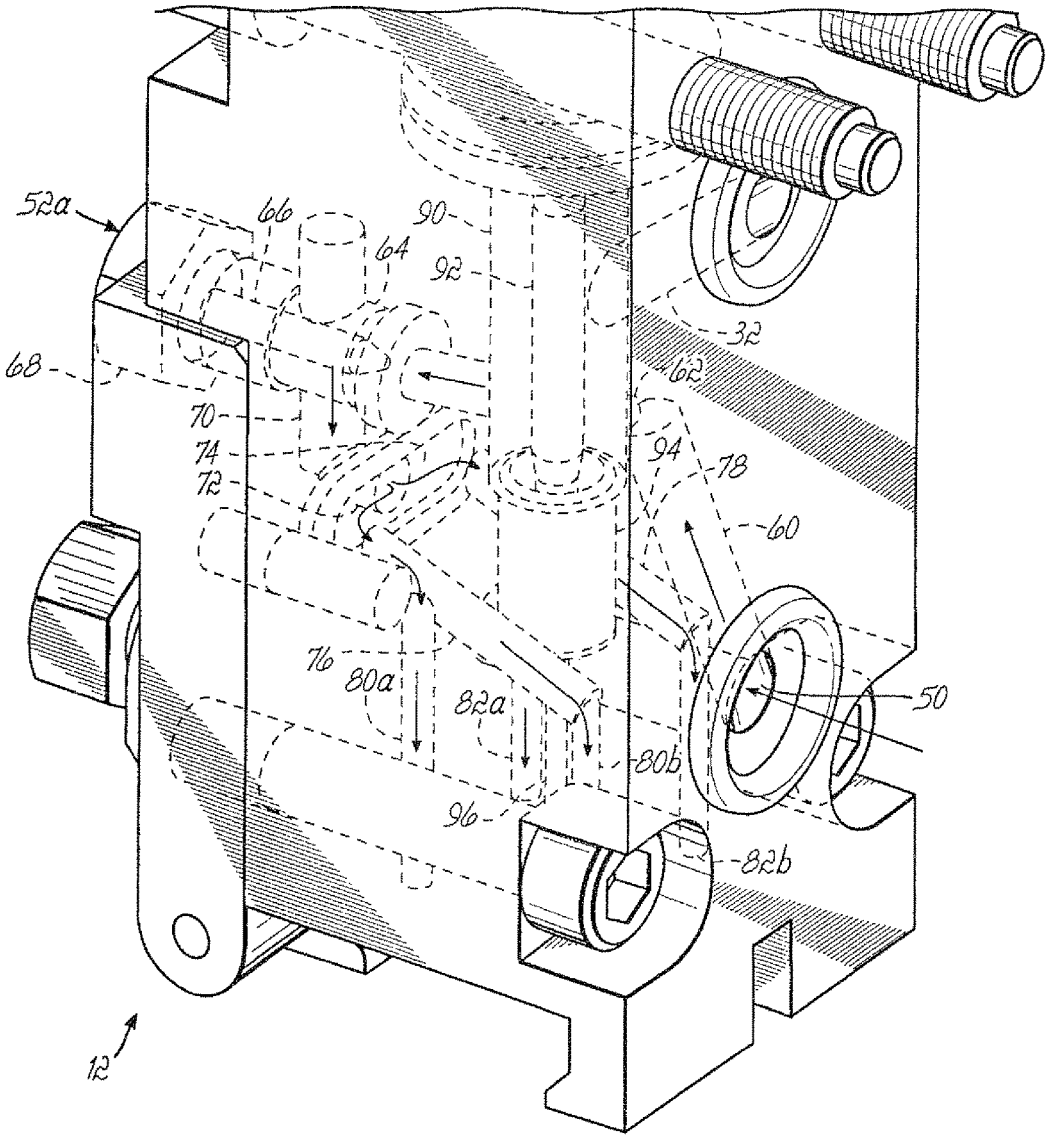
FIG. 3 is a partial perspective view of an exemplary liquid dispensing module in accordance with the principles of the present invention.

FIG. 3 illustrates detail of an exemplary dispensing module 12 having a needle valve 52*a* for selectively adjusting the flow rate and/or pressure of air provided to module 12 through an air manifold. Process air enters air inlet 50 and flows along inclined passage 60 and substantially horizontal passage 62 to an inlet bore (not shown) in valve body 64. A stem 66 of the needle valve 52*a* can be adjusted between a fully closed position, a fully open position, and a plurality of intermediate positions, relative to the inlet bore of the valve body 64, by manipulating control knob 68 to thereby regulate process air flowing through valve body 64. Regulated process air thereafter passes from the valve body 64 through vertical passage 70 and horizontal passage 72 to an air distribution channel 74. First and second air distribution passages 76, 78 communicate with the distribution channel 74 so that regulated process air flows along air distribution passages 76, 78 to air outlet passages 80*a*, 80*b* communicating with air distribution passage 76, and air outlet passages 82*a*, 82*b* communicating with air distribution passage 78. Process air flows along air outlet passages 80*a*, 80*b*, 82*a*, 82*b* to corresponding inlets on a dispensing nozzle or die 18 (FIG. 2) as known in the art.

Liquid material from a manifold enters the module 12 through liquid inlet passage 32 which communicates with vertical bore 90. Valve stem 92 is disposed within vertical bore 90 and is movable for selective engagement with liquid dispensing valve body 94 to selectively control the dispensing of liquid material through liquid outlet passage 96 to nozzle 18, as known in the art.

Figure 4:
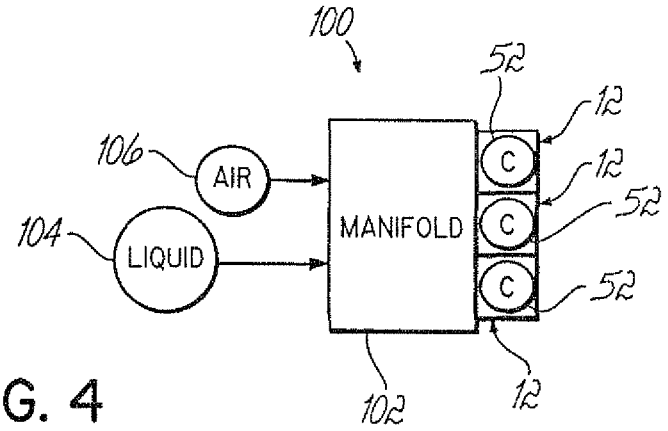
FIGS. 4-8 are schematic illustrations depicting various additional exemplary embodiments of liquid dispensing systems in accordance with the principles of the present invention.

FIG. 4 is a schematic illustration depicting an exemplary liquid dispensing system 100 as shown and described with respect to the particular exemplary embodiments of such a liquid dispensing system 10, 10*a*, discussed above with respect to FIGS. 1, 2 and 2A. Liquid dispensing system 100 includes a manifold 102 for receiving and optionally heating liquid material and process air from respective liquid material and air sources 104, 106, and for distributing the liquid and process air to one or more liquid dispensing modules 12 coupled to manifold 102. Air from the common air source 106 is not individually controlled prior to entering the manifold 102. Instead, process air is distributed to individual modules 12 that include controls 52, such as needle valves or other devices, to individually regulate the pressure and/or flow rate of process air directly at the module 12, as shown and described with respect to FIG. 3, for example. Controls 52 may be part of modules 12, or they may be located in the flow path between the modules 12 and their respectively associated nozzles or dies, as discussed above.

The manifold 102 may comprise a plurality of manifold segments, as shown and described in pending U.S. patent application Ser. No. 10/836,765. These segments may be integrated such that air and liquid manifold distribution functions are performed by each segment, as shown and described in pending U.S. patent application Ser. No. 10/836,765, or the segments may comprise separate air and liquid manifold portions, as shown and described in pending U.S. patent application Ser. No. 10/282,573. Alternatively, manifold 102 may be in the form of a common manifold (without segments), wherein liquid material and process air are distributed to each module 12 through the common manifold, as shown and described with respect to FIGS. 1, 2 and 2A. The common manifold may be integrated to perform both liquid and air manifold functions as depicted in FIG. 2, or the manifold may comprise separate liquid and air manifold portions, as depicted in FIG. 2A.

Figure 5:
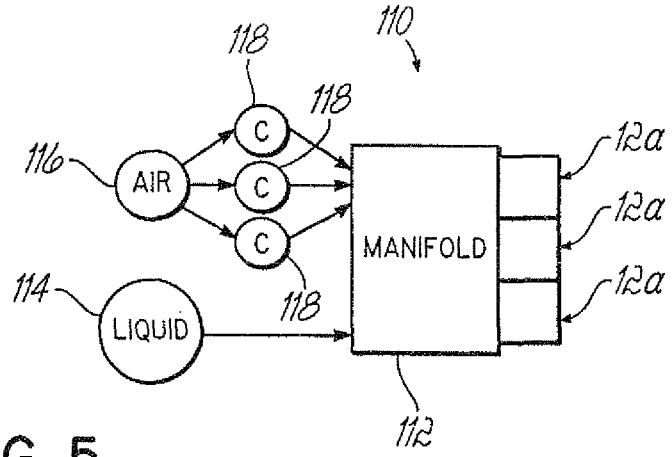

FIG. 5 is a schematic illustration depicting an exemplary liquid dispensing system 110 as shown and described with respect to the particular exemplary embodiment of such a liquid dispensing system discussed above with respect to FIG. 2B. Liquid dispensing system 110 includes a manifold 112 for receiving liquid material and process air from respective liquid material and air sources 114, 116, and for distributing the liquid and process air to one or more liquid dispensing modules 12*a* coupled to manifold 112. Process air from the common air source 116 is regulated by individual controls 118 associated with each module 12*a* prior to entering the manifold 112, where it may be heated and distributed to the respective modules 12*a*.

The manifold 112 may be in the form of a common manifold (without segments), wherein liquid material and process air are distributed to each module 12*a* through the common manifold, as shown and described with respect to FIGS. 1, 2 and 2A. The common manifold may be integrated to perform both liquid and air manifold functions, as depicted in FIG. 2, or the manifold may comprise separate liquid and air manifold portions, as depicted in FIGS. 2A and 2B.

Alternatively, manifold 112 may comprise a plurality of manifold segments, as shown and described in pending U.S. patent application Ser. No. 10/282,573 and Ser. No. 10/836,765, wherein each segment meters liquid material and process air to an individual module 12*a*. These segments may be integrated such that air and liquid manifold functions are performed by each segment, as shown and described in pending U.S. patent application Ser. No. 10/836,765, or the segments may comprise separate air and liquid manifold portions, as shown and described in pending U.S. patent application Ser. No. 10/282,573.

Figure 6:
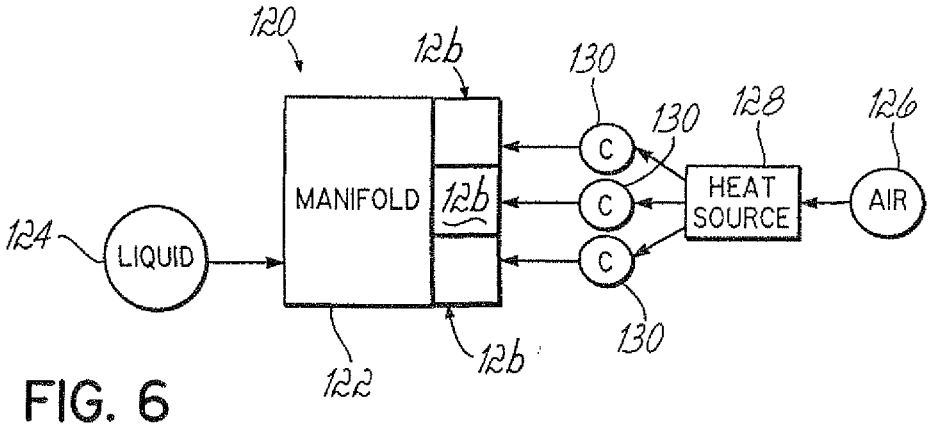

FIG. 6 is a schematic illustration depicting another exemplary liquid dispensing system 120 in accordance with the principles of the present invention. In this embodiment, liquid material from a liquid source 124 is heated by a liquid manifold 122 and distributed to one or more liquid dispensing modules 12*b* coupled to manifold 122. The liquid dispensing system 120 does not include an air manifold. Rather, process air from an air source 126 may be heated by an external heat source 128 and provided directly to the dispensing modules 12*b*, such as through inlet ports (not shown) on modules 12*b*, after passing through external controls 130 which are adjustable to regulate the pressures and/or flow rates of the process air entering each associated module 12*b*.

Liquid manifold 122 may comprise a plurality of manifold segments as shown and described in pending U.S. patent application Ser. No. 10/282,573 and Ser. No. 10/836,765, or liquid manifold 122 may be in the form of a common manifold (without segments), similar to the liquid manifold portion 14*a* of FIG. 2A, wherein liquid material is distributed to each module 12*b* though the common manifold 122.

Figure 7:
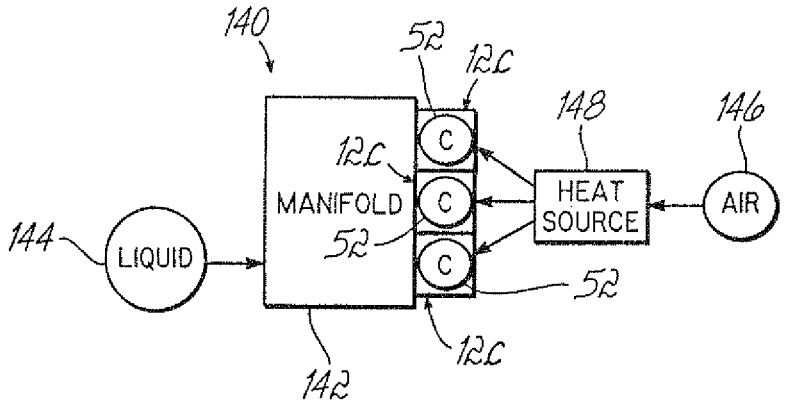

FIG. 7 is a schematic illustration depicting yet another exemplary liquid dispensing system 140 in accordance with the principles of the present invention. In this embodiment liquid material from a liquid source 144 is heated by a liquid manifold 142 and is distributed to one or more liquid dispensing modules 12*c* coupled to manifold 142. The liquid dispensing system 140 does not include an air manifold. Rather, unregulated process air from an air source 146, which may be heated by an external heat source 148, is provided directly to the dispensing modules 12*c*, such as through inlet ports (not shown) on the modules 12*c*. Modules 12*c* include controls 52, such as needle valves or other devices, to individually regulate the pressure and/or flow rate of the process air directly at the module 12*c*, in a manner similar to that shown and described with respect to module 12 of FIG. 3. Controls 52 may be part of the modules 12*c*, or they may be in the flow path between the modules 12*c* and their respectively associated nozzles or dies.

Liquid manifold 142 may comprise a plurality of manifold segments, as shown and described in pending U.S. patent application Ser. No. 10/282,573 and Ser. No. 10/836,765. Alternatively, liquid manifold 142 may be in the form of a common manifold (without segments), similar to the liquid manifold portion 14*a* of FIG. 2A, wherein liquid material is distributed to each module 12*c* though the common manifold 142.

Figure 8:
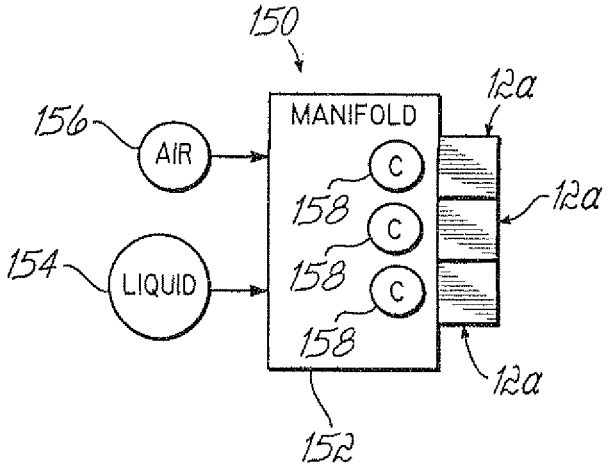

FIG. 8 is a schematic illustration depicting another exemplary liquid dispensing system 150 in accordance with the principles of the present invention. In this embodiment, liquid dispensing system 150 includes a manifold 152 for receiving and optionally heating liquid material and process air from respective liquid material and air sources 154, 156, and for distributing the liquid and process air to one or more liquid dispensing modules 12*a* coupled to manifold 152. Air from the air source is not individually controlled prior to entering the manifold 152. Instead, manifold 152 includes controls 158, such as needle valves or other devices suitable for controlling the pressure and/or flow rate of the process air, associated with each module 12*a* to individually regulate the pressure and/or flow rate of process air distributed to the respective modules 12*a*. Controls 158 may be part of the manifold 152, or they may be in the flow path between the manifold 152 and the modules 12*a*.

The manifold 152 may comprise a plurality of manifold segments, as shown and described in pending U.S. patent application Ser. No. 10/282,573 and Ser. No. 10/836,765. These segments may be integrated such that air and liquid manifold distribution functions are performed by each segment, as shown and described in pending U.S. patent application Ser. No. 10/836,765, or the segments may comprise separate air and liquid manifold portions, as shown and described in pending U.S. patent application Ser. No. 10/282,573. Alternatively, manifold 152 may be in the form of a common manifold (without segments), wherein liquid material and process air are distributed to each module 12*a* through the common manifold, as shown and described with respect to FIGS. 1, 2 and 2A. The common manifold may be integrated to perform both liquid and air manifold functions as depicted in FIG. 2, or the manifold may comprise separate liquid and air manifold portions, as depicted in FIG. 2A.

Figure 9:
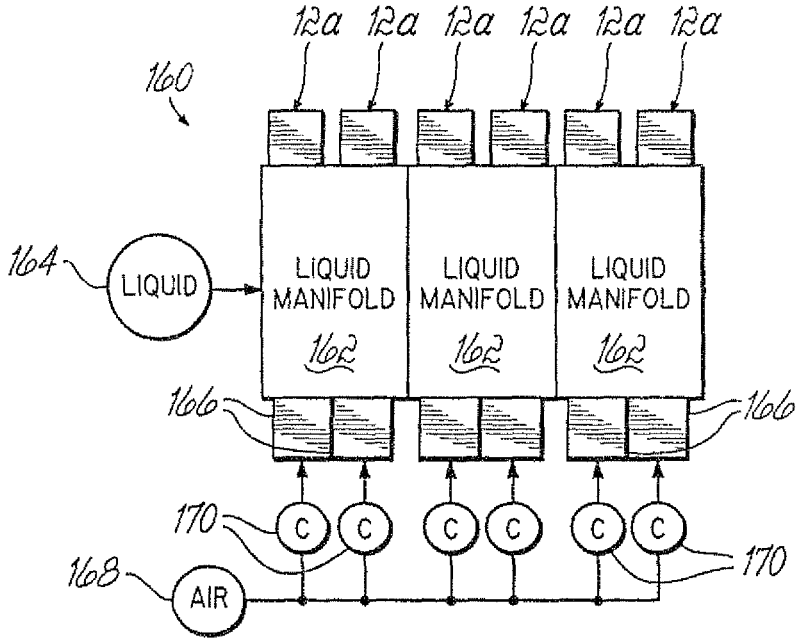
FIGS. 9-9A are schematic illustrations depicting embodiments of liquid dispensing systems having plural modules associated with liquid manifold segments.

While the exemplary embodiments shown and described above illustrate liquid dispensing systems wherein liquid material is supplied or metered to individual liquid dispensing modules, it will be appreciated that liquid material may alternatively be supplied or metered to groups of liquid dispensing modules. For example, FIG. 9 is a schematic illustration depicting a liquid dispensing system 160 having a segmented manifold with multiple modules 12*a* associated with each liquid manifold segment 162. Liquid material from a liquid source 164 is supplied to the liquid manifold segments 162 where it may be heated and metered to the respectively associated modules 12*a*. In the embodiment shown, two modules 12*a* are associated with each liquid manifold segment 162, but it will be recognized that a single nozzle 12*a*, or alternatively, three or more modules 12*a*, may alternatively be associated with each liquid manifold segment.

The dispensing system 160 further includes a plurality of air manifold segments 166 associated with each liquid manifold segment 162; one for each liquid dispensing module 12*a*. Process air from an air source 168 is regulated by a plurality of controls 170 disposed between the air source 168 and the respective air manifold segments 166, whereby the flow rate and/or pressure of process air provided to each module 12*a* can be individually controlled. While liquid dispensing system 160 is shown and described as having individual air manifold segments 166 associated with each module 12*a*, it will be appreciated that the liquid dispensing system 160 may alternatively include air manifold segments associated with two or more modules 12*a*, or that a single air manifold may be associated with all of the modules 12*a*.

Figure 9A:
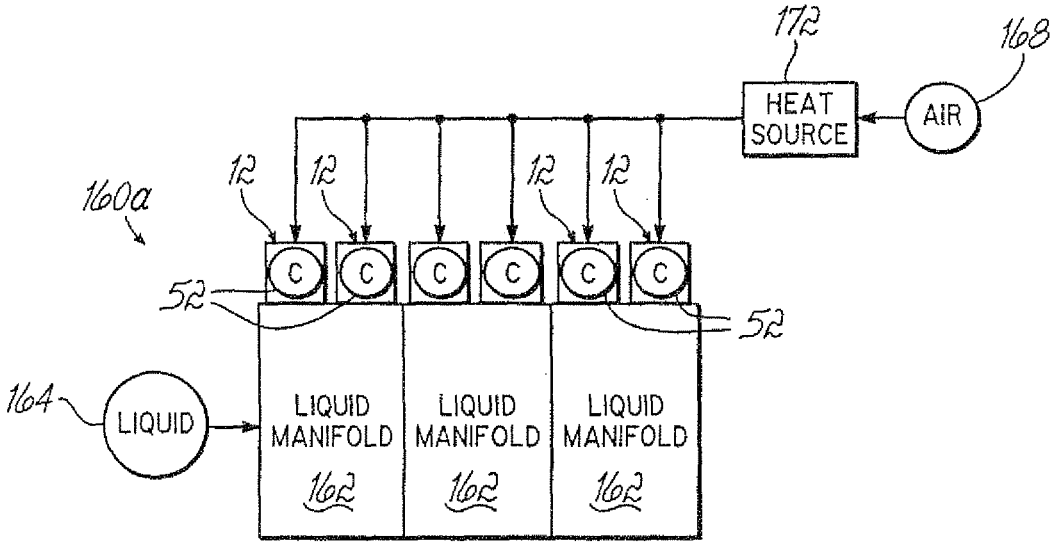

FIG. 9A depicts another embodiment, similar to the liquid dispensing system 160 of FIG. 9, but wherein each module 12 is includes a control 52 to regulate the flow rate and/or pressure of process air directly at the module 12, in a manner similar to that described above with respect to FIG. 3. Controls 52 may be part of modules 12, or they may be in the flow path between the modules 12 and their respectively associated nozzles or dies. In the embodiment shown, liquid dispensing system 160*a* includes a plurality of liquid manifold segments 162 for heating liquid material from a liquid source 164 and for supplying heated liquid material to groups of liquid dispensing modules 12 associated with each liquid manifold segment 162. The dispensing system 160*a* does not include an air manifold. Rather, process air from an air source 168, which may be heated by an external heater 172, is provided directly to the modules 12 where it is regulated by the controls 52.

Figure 10:
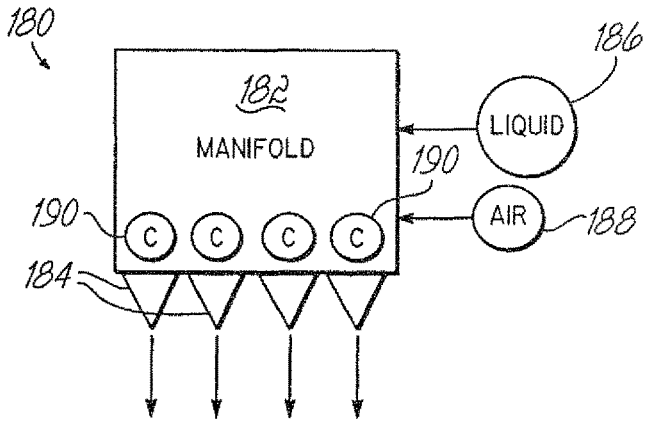
FIGS. 10-10B are schematic illustrations depicting embodiments of continuous liquid dispensing systems in accordance with the principles of the present invention.

Individualized process air control has been described above with respect to various exemplary embodiments wherein the liquid dispensing systems include modules that facilitate individually controlling the liquid material dispensed from respectively associated nozzles or dies. It will be appreciated, however, that process air may also be individually controlled in continuous liquid material dispensing systems having one or more nozzles or dies coupled directly to the manifolds. FIG. 10 is a schematic illustration of an exemplary liquid dispensing system 180 having a manifold 182 with a plurality of nozzles or dies 184 for dispensing liquid material. The plurality of dies are simultaneously controlled to start and stop the flow of liquid material as known in the art. Liquid material and process air are supplied to the manifold 182 from respective liquid and air sources 186, 188 where it may be heated and distributed to the nozzles or dies 184. The manifold 182 further includes a plurality of controls 190 associated with the nozzles or dies 184 for regulating the flow rate and/or pressure of process air provided to each nozzle or die 184, in a manner similar to that described above. Controls 190 may be part of manifold 182, or they may be in the flow path between the manifold 182 and the nozzles or dies 184.

Figure 10A:
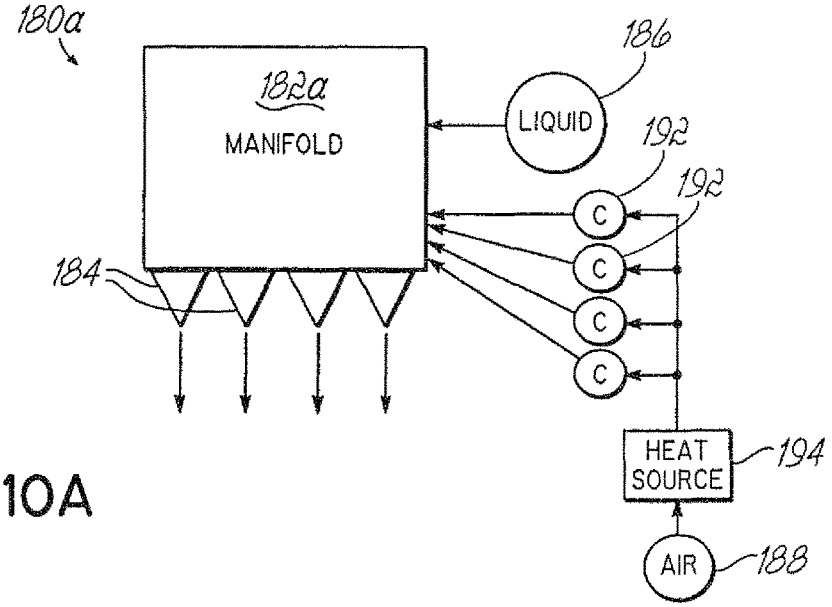

FIG. 10A is a schematic illustration of another exemplary embodiment of a liquid dispensing system 180*a* having a manifold 182*a* for receiving and optionally heating liquid material and process air from liquid and air sources 186, 188 and distributing the liquid material and process air to respective nozzles or dies 184. Instead of controls 190 in the manifold, liquid dispensing system 180*a* includes controls 192 provided between the air source 188 and the manifold 182*a*. If the manifold 182*a* is not configured to receive and heat the process air, the liquid dispensing system may optionally include an external heater 194 for heating the air from air source 188.

Figure 10B:
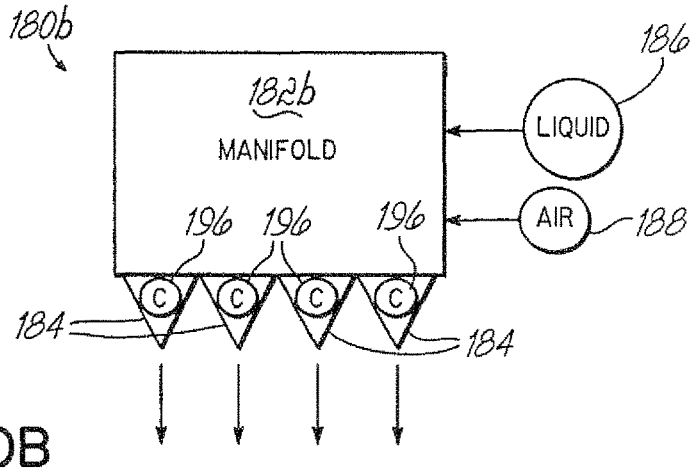

FIG. 10B is a schematic illustration of yet another embodiment of a liquid dispensing system 180*b*, having a manifold 182*b* for receiving and optionally heating liquid material and process air from liquid and air sources 186, 188 in a manner similar to the embodiment shown and described above with respect to FIG. 10. In this embodiment, however, each nozzle or die 184 includes a control 196 for regulating the flow rate and/or pressure of process air directly at the nozzle or die 184.

Figure 11:
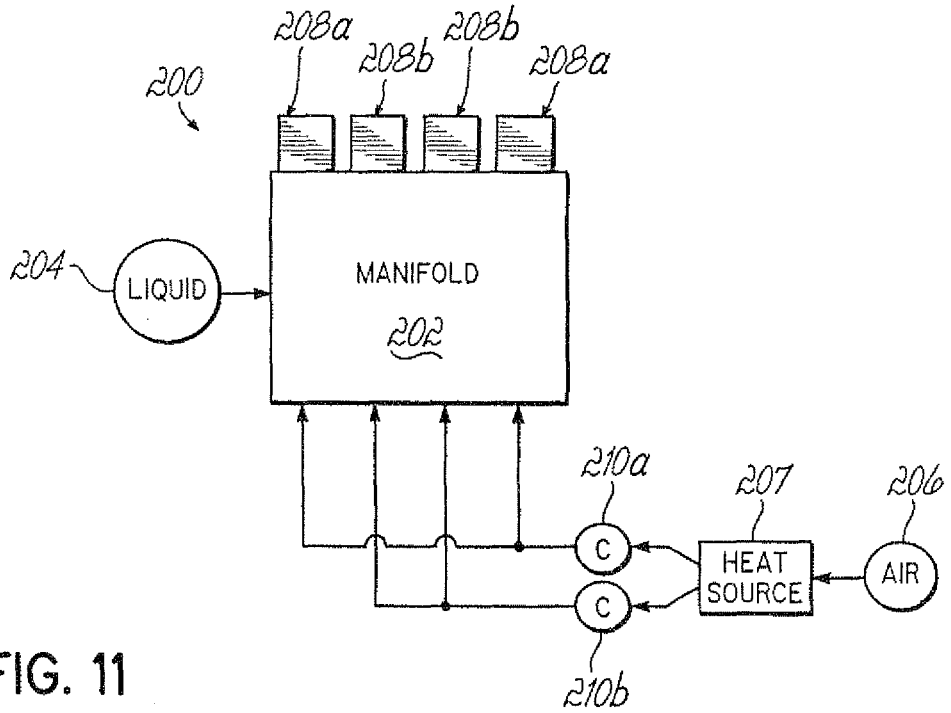
FIGS. 11-11A are schematic illustrations depicting embodiments of liquid dispensing systems wherein process air to plural modules or nozzles are simultaneously controlled.

While the liquid dispensing systems discussed above have utilized controls to regulate the flow rate and/or flow rate of process air provided to individual modules or nozzles, it will be appreciated that one or more controls may alternatively be associated with two or more of the modules or nozzles, such that process air to a group of modules or nozzles can be simultaneously controlled. For example, FIG. 11 is a schematic illustration of a liquid dispensing system 200 wherein manifold 202 receives liquid material and process air from respective liquid and air sources 204, 206. Liquid material and process air are heated in the manifold and distributed to a plurality of dispensing modules or nozzles 208*a*, 208*b* coupled to the manifold 202. The liquid dispensing system 200 further includes controls 210*a*, 210*b* between air source 206 and the manifold 202. Control 210*a* is associated with a first plurality of the modules or nozzles 208*a*, and control 210*b* is associated with a second plurality of modules or nozzles 208*b*, such that the flow rate and/or pressure of process air provided to the plural modules or nozzles 208*a*, 208*b* can be simultaneously regulated by respectively associated controls 210*a*, 210*b*. If manifold 202 is not configured to heat the process air, liquid dispensing system 200 may optionally include an external heat source 207 for heating the air.

Figure 11A:
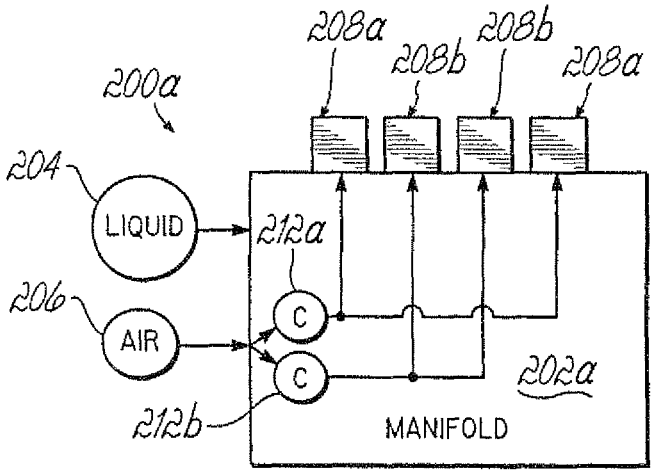

FIG. 11A is a schematic illustration of a liquid dispensing system 200*a*, similar to the liquid dispensing system 200 of FIG. 11. Liquid material and process air from liquid and air sources 204, 206 are heated in manifold 202*a* and distributed to modules or nozzles 208*a*, 208*b*. Instead of controls 210*a*, 210*b* between the air source 206 and the manifold 202*a*, manifold 202*a* includes controls 212*a*, 212*b* for regulating the flow rate and/or pressure of process air distributed to the modules or nozzles 208*a*, 208*b*. Control 212*a* is associated with a first plurality of modules or nozzles 208*a*, and control 212*b* is associated with a second plurality of modules or nozzles 208*b*, such that that the flow rate and/or pressure of process air provided to the plural modules or nozzles 208*a*, 208*b* can be simultaneously regulated by respectively associated controls 212*a*, 212*b*. Controls 212*a*, 212*b* may be part of manifold 202*a* or they may be in the flow path between the manifold 202*a* and their respectively associated modules 208*a*, 208*b*.

Figure 12:
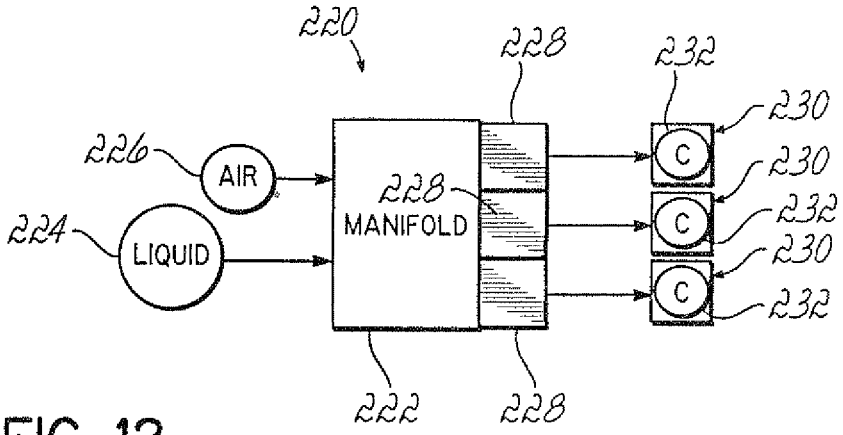
FIGS. 12-12A are schematic illustrations depicting embodiments of liquid dispensing systems wherein process air is controlled at the dies or nozzles.

FIG. 12 is a schematic illustration of another liquid dispensing system 220 in accordance with the principles of the present invention. Liquid dispensing system 220 includes a manifold 222 for receiving and optionally heating liquid and process air from respective liquid material and process air sources 224, 226, and for distributing the liquid material and process air to respective modules 228 coupled to the manifold. Each module includes a nozzle or die 230 having a control 232 for regulating the flow rate and/or pressure of process air directly at the nozzle or die 232.

Manifold 222 may be in the form of a common manifold (without segments), wherein liquid material and process air are distributed to each module 228 through the common manifold, as shown and described with respect to FIGS. 1, 2 and 2A. The common manifold may be integrated to perform both liquid and air manifold functions, as depicted in FIG. 2, or the manifold may comprise separate liquid and air manifold portions, as depicted in FIGS. 2A and 2B. Alternatively, manifold 222 may comprise a plurality of manifold segments, as shown and described in pending U.S. patent application Ser. No. 10/282,573 and Ser. No. 10/836,765, wherein each segment meters liquid material and process air to an individual module 228. These segments may be integrated such that air and liquid manifold functions are performed by each segment, as shown and described in pending U.S. patent application Ser. No. 10/836,765, or the segments may comprise separate air and liquid manifold portions, as shown and described in pending U.S. patent application Ser. No. 10/282,573. For example, as described in U.S. patent application Ser. No. 10/836,765 (incorporated by reference above), the applicator or dispensing system includes several manifold segments that are coupled together. The applicator or dispensing system further includes electric cord sets and heater rods (not shown, although a schematic black box version entitled "heater" 34 is provided in FIGS. 2 through 2B) for heating the manifold segments.

Figure 12A:
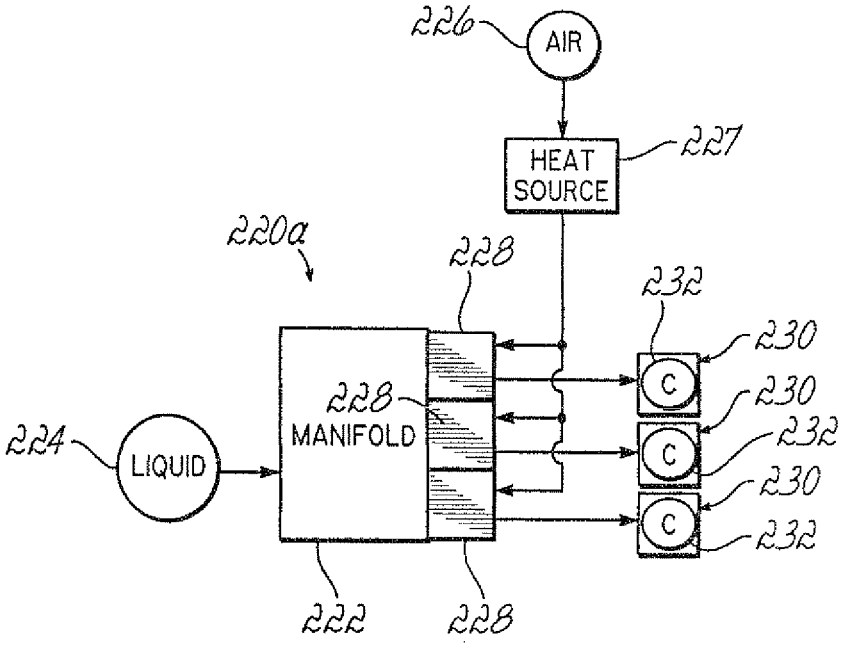

FIG. 12A is a schematic illustration of an exemplary liquid dispensing system 220*a*, similar to the liquid dispensing system 220 of FIG. 12, but wherein the liquid dispensing system 220*a* does not include an air manifold. Rather, process air from an air source 226, which may be heated by external heat source 227, is provided directly to the dispensing modules 228, as discussed above. Each module includes a nozzle or die 230 having a control 232 for regulating the flow rate and/or pressure of process air directly at the nozzle or die 232.

Liquid manifold 222*a* may comprise a plurality of manifold segments as shown and described in pending U.S. patent application Ser. No. 10/282,573 and Ser. No. 10/836,765, or liquid manifold 222*a* may be in the form of a common manifold (without segments), similar to the liquid manifold portion 14*a* of FIG. 2A, wherein liquid material is distributed to each module 228 though the common manifold 222*a*.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A hot melt adhesive dispenser utilizing pressurized heated process air from a pressurized air source to act on hot melt adhesive streams being dispensed onto a substrate moving relative to the dispenser, the dispenser comprising:

a heated manifold receiving the hot melt adhesive, said heated manifold having a first liquid material passage that supplies a first heated stream of hot melt adhesive, a second liquid material passage that supplies a second heated stream of hot melt adhesive, said heated manifold heating the first and second heated streams of hot melt adhesive;

a first dispensing module in fluid communication with said first liquid material passage and receiving the first heated stream of hot melt adhesive, said first dispensing module having a first air passageway communicating with the pressurized air source and receiving a first heated process air flow, and a first control valve communicating with said first air passageway;

a first nozzle in fluid communication with said first dispensing module, said first nozzle receiving and subsequently dispensing the first heated stream of hot melt adhesive onto the substrate, and receiving and subsequently discharging the first heated process air flow so that the first heated process air flow attenuates the dispensed first heated stream of hot melt adhesive;

a second dispensing module in fluid communication with said second liquid material passage and receiving the second heated stream of hot melt adhesive, said second dispensing module having a second air passageway communicating with the pressurized air source and receiving a second heated process air flow, and a second control valve communicating with said second air passageway; and a second nozzle in fluid communication with said second dispensing module, said second nozzle receiving and subsequently dispensing the second heated stream of hot melt adhesive onto the substrate, and receiving and subsequently discharging the second heated process air flow so that the second heated process air flow attenuates the dispensed second heated stream of hot melt adhesive;

wherein said first control valve adjusts a first flow rate and/or pressure of the first heated process air flow in said first air passageway, and said second control valve adjusts a second flow rate and/or pressure of the second heated process air flow in said second air passageway independent of the first flow rate and/or pressure of the first heated process air flow so that the first flow rate and/or pressure is different than the second flow rate and/or pressure, and wherein said first control valve includes a first valve member that moves between a fully closed position, a fully opened position, and a plurality of intermediate partially-opened positions to adjust the first flow rate and/or pressure of the first heated process air flow in said first air passageway, and said second control valve includes a second valve member that moves between a fully closed position, a fully opened position, and a plurality of intermediate partially-opened positions to adjust a second flow rate and/or pressure of the second heated process air flow in said second air passageway independent of the first flow rate and/or pressure of the first heated process air flow so that the first flow rate and/or pressure and the second flow rate and/or pressure are different non-zero values.

2. The hot melt adhesive dispenser of claim 1, wherein said heated manifold comprises:

a liquid manifold portion; and a separate air manifold portion joined to said liquid manifold portion;

said air manifold portion including first and second air passages providing communication between the pressurized air source and said respective first and second air passageways in said respective first and second dispensing modules.

3. The hot melt adhesive dispenser of claim 2, wherein said liquid manifold portion includes first and second segments, said first liquid manifold segment including said first liquid material passage, and said second liquid manifold segment including said second liquid material passage.

4. The hot melt adhesive dispenser of claim 3, wherein the heated manifold includes a heater that heats said first and second segments, thereby providing heat energy to said first liquid material passage and said second liquid material passage.

5. The hot melt adhesive dispenser of claim 2, wherein said air manifold portion includes first and second segments, said first air manifold segment including said first air passage, and said second air manifold segment including said second air passage.

6. The hot melt adhesive dispenser of claim 1, wherein said heated manifold further comprises:

first and second air passages;

said first air passage providing communication between the pressurized air source and said first air passageway in said first dispensing module; and said second air passage providing communication between the pressurized air source and said second air passageway in said second dispensing module.

7. The hot melt adhesive dispenser of claim 6, wherein said heated manifold comprises first and second segments, said first segment including said first liquid material passage and said first air passage, said second segment including said second liquid material passage and said second air passage.

8. The hot melt adhesive dispenser of claim 7, wherein the heated manifold includes a heater that heats said first and second segments, thereby providing heat energy to said first liquid material passage and said first air passage, and also to said second liquid material passage and said second air passage.

9. The hot melt adhesive dispenser of claim 1, wherein said first control valve includes a first valve inlet bore communicating with said first air passageway and said first valve member includes a first needle that moves towards and away from contact with said first valve inlet bore to thereby adjust the first flow rate and/or pressure of the first heated process air flow in said first air passageway, and said second control valve includes a second valve inlet bore communicating with said second air passageway and said second valve member includes a second needle that moves towards and away from contact with said second valve inlet bore to thereby adjust the second flow rate and/or pressure of the second heated process air flow in said second air passageway independent of the first flow rate and/or pressure of the first heated process air flow so that the first flow rate and/or pressure is different than the second flow rate and/or pressure.

10. A hot melt adhesive dispenser utilizing pressurized heated process air from a pressurized air source to act on hot melt adhesive streams being dispensed onto a substrate moving relative to the dispenser, the dispenser comprising:

a heated manifold adapted to receive the hot melt adhesive, said heated manifold having a first liquid material passage that supplies a first stream of hot melt adhesive, a second liquid material passage that supplies a second stream of hot melt adhesive;

a first dispensing module in fluid communication with said first liquid material passage and receiving the first stream of hot melt adhesive, said first dispensing module having a first air passageway communicating with the pressurized air source and receiving a first heated process air flow, and a first control valve communicating with said first air passageway;

a first nozzle in fluid communication with said first dispensing module, said first nozzle receiving and subsequently dispensing the first stream of hot melt adhesive onto the substrate, and receiving and subsequently discharging the first heated process air flow so that the first heated process air flow attenuates the dispensed first stream of hot melt adhesive;

a second dispensing module in fluid communication with said second liquid material passage and receiving the second stream of hot melt adhesive, said second dispensing module having a second air passageway communicating with the pressurized air source and receiving a second heated process air flow, and a second control valve communicating with said second air passageway; and a second nozzle in fluid communication with said second dispensing module, said second nozzle receiving and subsequently dispensing the second stream of hot melt adhesive onto the substrate, and receiving and subsequently discharging the second heated process air flow so that the second heated process air flow attenuates the dispensed second stream of hot melt adhesive;

wherein said first control valve adjusts a first flow rate and/or pressure of the first heated process air flow in said first air passageway, and said second control valve adjusts a second flow rate and/or pressure of the second heated process air flow in said second air passageway independent of the first flow rate and/or pressure of the first heated process air flow so that the first flow rate and/or pressure is different than the second flow rate and/or pressure, wherein said first control valve includes a first valve inlet bore communicating with said first air passageway and a first needle that moves towards and away from contact with said first valve inlet bore to thereby adjust the first flow rate and/or pressure of the first heated process air flow in said first air passageway, and said second control valve includes a second valve inlet bore communicating with said second air passageway and a second needle that moves towards and away from contact with said second valve inlet bore to thereby adjust the second flow rate and/or pressure of the second heated process air flow in said second air passageway independent of the first flow rate and/or pressure of the first heated process air flow so that the first flow rate and/or pressure is different than the second flow rate and/or pressure, and wherein said first air passageway and said first valve inlet bore define a first axis along which the first heated process air flow moves into said first control valve, and said first needle moves along the first axis towards and away from said first valve inlet bore to modify the first flow rate and/or pressure of the first heated process air flow.

11. The hot melt adhesive dispenser of claim 10, wherein said second air passageway and said second valve inlet bore define a second axis along which the second heated process air flow moves into said second control valve, and said second needle moves along the second axis towards and away from said second valve inlet bore to modify the second flow rate and/or pressure of the second heated process air flow.

* * * * *